US006758340B1

(12) United States Patent
Feibelman

(10) Patent No.: US 6,758,340 B1
(45) Date of Patent: Jul. 6, 2004

(54) DISPLAY BOX WITH SLEEVE

(75) Inventor: Jeffrey A. Feibelman, Providence, RI (US)

(73) Assignee: Display Technologies, Inc., Johnston, RI (US)

( * ) Notice: Subject to any disclaimer, the term of this patent is extended or adjusted under 35 U.S.C. 154(b) by 182 days.

(21) Appl. No.: 10/197,343

(22) Filed: Jul. 17, 2002

(51) Int. Cl.[7] ..... B65D 25/54
(52) U.S. Cl. ..... 206/775; 206/474; 206/776
(58) Field of Search ..... 206/472, 473, 206/474, 475, 775, 776, 777, 774, 769

(56) References Cited

U.S. PATENT DOCUMENTS 2,019,250 A * 10/1935 Collins ..... 206/777
4,111,413 A * 9/1978 Marcus ..... 472/137
4,440,297 A * 4/1984 Wohlfahrt ..... 206/777
D309,434 S 7/1990 Goldman
5,117,971 A * 6/1992 Fisher ..... 206/6.1
5,123,527 A 6/1992 Hustad
5,183,199 A 2/1993 Bills
5,219,071 A * 6/1993 Knapp ..... 206/6.1
5,232,087 A * 8/1993 Schluger ..... 206/45.29
5,409,105 A * 4/1995 Appelbaum et al. ..... 206/6.1
5,590,779 A 1/1997 Ramsey
6,047,829 A 4/2000 Johnstone et al.
6,193,057 B1 * 2/2001 Cappiello, Sr. ..... 206/6.1
6,234,308 B1 5/2001 Saffron et al.
6,471,053 B1 * 10/2002 Feibelman ..... 206/6.1

* cited by examiner

*Primary Examiner*—Jila M. Mohandesi
(74) *Attorney, Agent, or Firm*—Salter & Michaelson

(57) ABSTRACT

A display package including a box having side walls, a top wall, a bottom wall, a back wall, an open front, a base member which supports the ornamental object therein, and a sleeve including a pair of side tabs which are insertable into the interior of the box in order to removably secure the sleeve to the box is disclosed. The sleeve may include a window or opening for viewing the ornamental object supported within the box, and is removable from the box in a manner which discourages theft, but is easy to assemble.

15 Claims, 9 Drawing Sheets

DISPLAY BOX WITH SLEEVE

TECHNICAL FIELD

The invention relates generally to a display package, and more particularly to a package including a box for supporting an ornamental object and a sleeve at least partially inserted within the box through which the ornamental object may be viewed.

BACKGROUND OF RELATED ART

When packaging and displaying an ornamental object, such as a piece of jewelry, the object is often displayed in a package which provides an appealing visual display, while also functioning as a storage or travel container for the article of jewelry. One such package includes a box having an open top, a pad or other base member disposed within the box for supporting the article of jewelry, and a sleeve member positioned over the open box and including a window through which the object may be viewed. In such a package, the sleeve is slid over the open box and can easily be removed by sliding the box from within the sleeve. These types of packages provide a visually appealing and cost effective display for articles of jewelry. However, the sleeve member may be easily removed from the box, either unintentionally or purposely. If unintentionally, the object positioned within the box may become damages, if purposely, the object may be easily stolen.

Thus, there is continued need in the art for display boxes which can display an ornamental object, such as a piece of jewelry, in an attractive and reliable fashion while also discouraging removal of the object and/or damage to the object disposed therein.

SUMMARY

It is an object of the display package disclosed herein to provide a device for displaying an ornamental object in an attractive and reliable fashion while also discouraging removal of the object and/or damage to the object. The display package preferably includes a box having side walls, a top wall, a bottom wall, a back wall, an open front, a base member which supports the ornamental object therein, and a sleeve including a pair of side tabs which are insertable into the interior of the box in order to removably secure the sleeve to the box. The sleeve preferably includes a window or opening for viewing the ornamental object supported within the box, and is removable from the box in a manner which discourages theft, but is easy to assemble. The sleeve is preferably positioned such that a front member overlays the open end of the box, and so that the ornamental object is viewable through the window. The side tabs are preferably folded and inserted between an interior surface of the side walls of the box and the base member. A top tab and a bottom tab are then folded so as to be positioned over and adjacent to the exterior of the top wall and bottom wall of the box, respectively. Thereafter, rear tabs of the sleeve are extended over the exterior of the back wall of the box and are removably interengaged with each other in order to removably secure the sleeve over the box.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Referring now to FIGS. 1–10, a display container 10 including a box 12 for supporting an ornamental object 11 and a sleeve 14 designed to fit over and within the box while allowing the ornamental object to remain visible is illustrated. As used herein, the term "ornamental object" refers to any item or product sold to a consumer including, but not limited to, jewelry. In the present embodiment, the sleeve 14 is partially inserted within the box during assembly in order to secure the sleeve and box together, as described in greater detail below.

Figure 1:
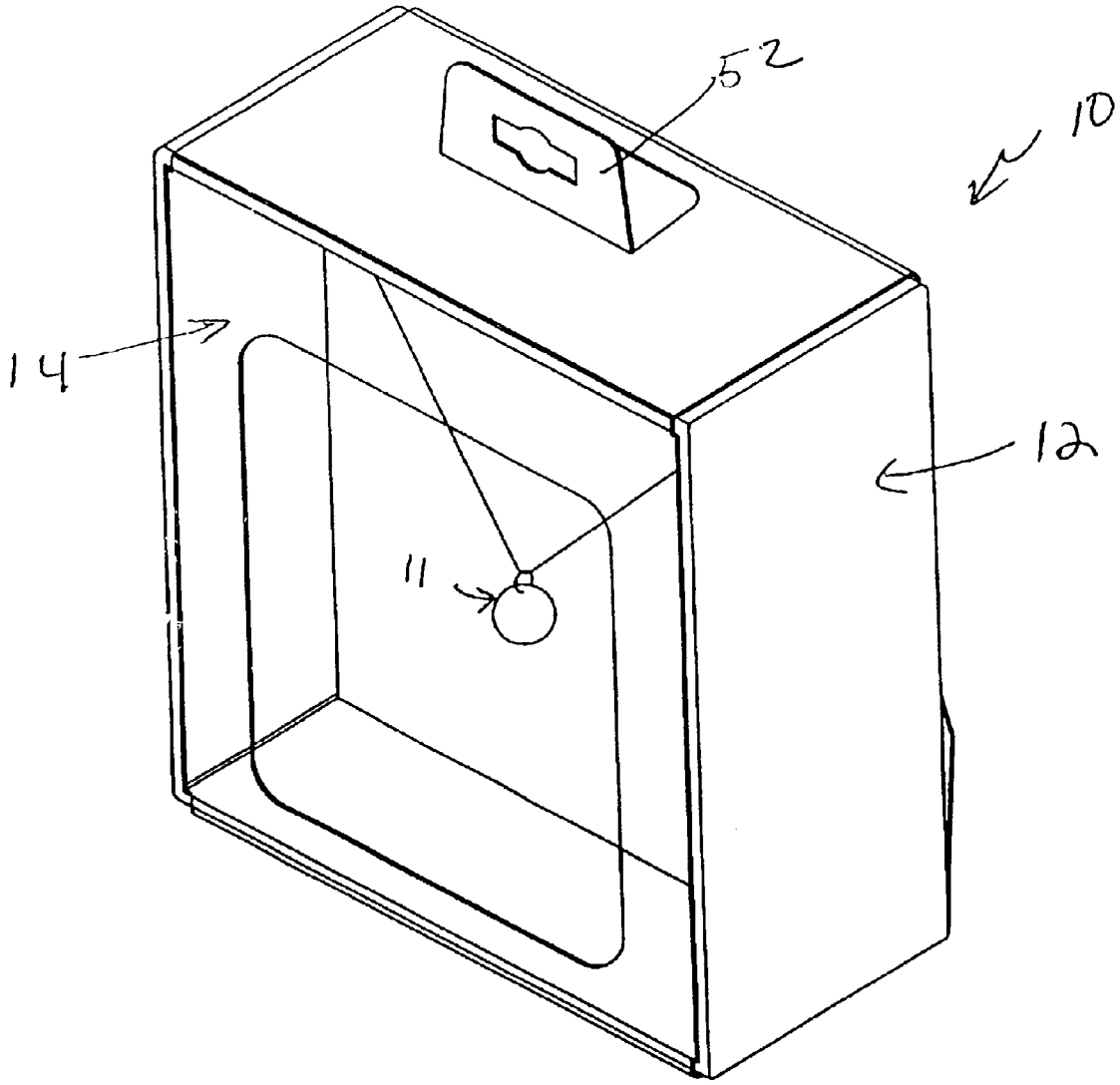
FIG. 1 is a perspective view of the display container with sleeve according to one embodiment.
Figure 2:
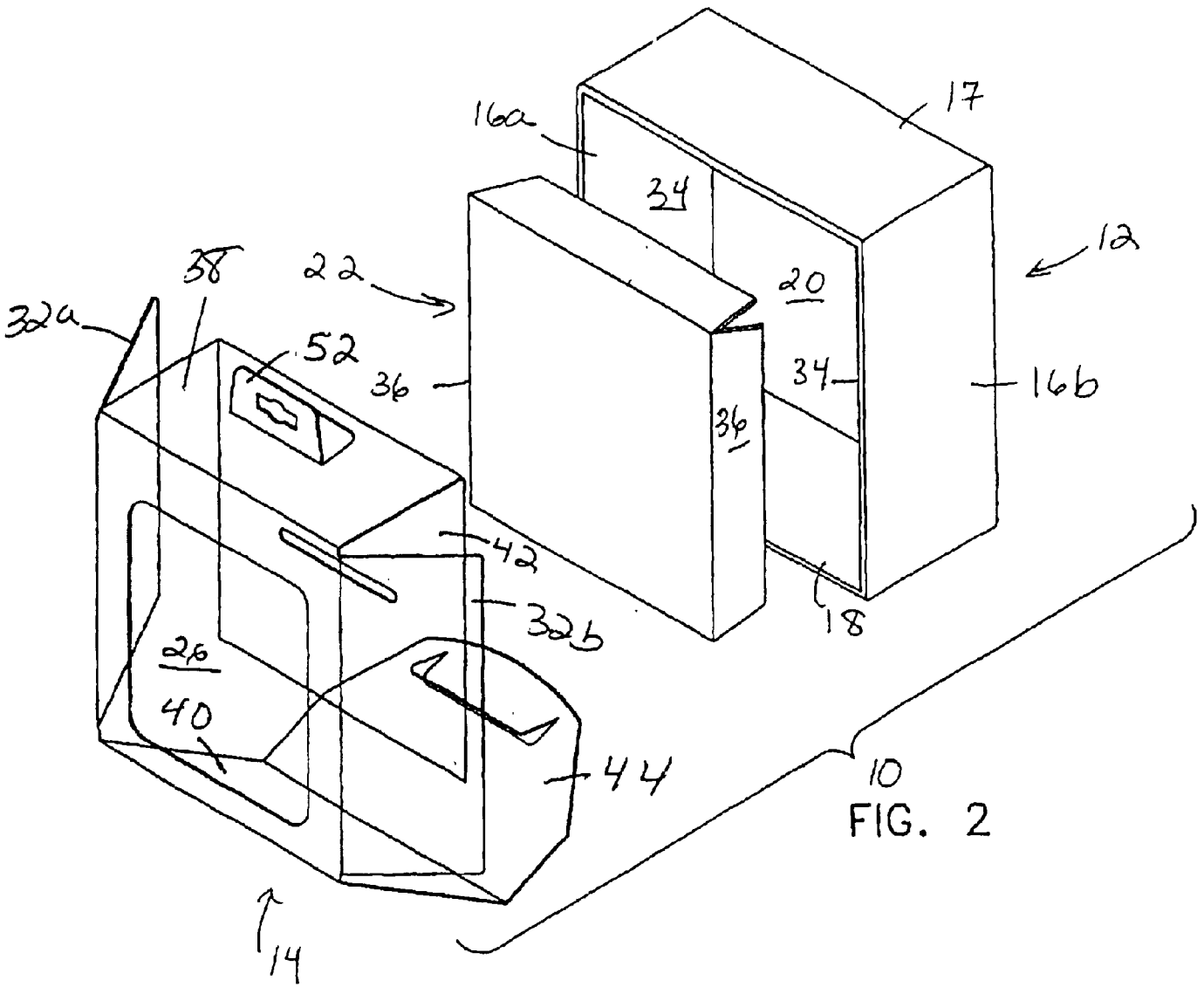
FIG. 2 is an exploded view of the display container of FIG. 1.

As shown in the Figures, the box 12 includes side walls 16*a*, 16*b*, a top wall 17, a bottom wall 18, and a back wall 20. A display pad or base member 22 is also preferably disposed within the box so as to support the ornamental object which is positioned thereon during use. In the present embodiment, the ornamental object is illustrated as a necklace, but any ornamental object may be supported within the box 12, as would be known to those of skill in the art. As best shown in FIG. 2, a front of the box 12 remains open. The box may be made of any suitable material, for example cardboard, as would be known to those of skill in the art. In use, the open end of the box 12 is covered by sleeve 14 which is wrapped around the exterior of the top wall 17, the bottom wall 18, and back wall 20 of the box.

Figure 3:
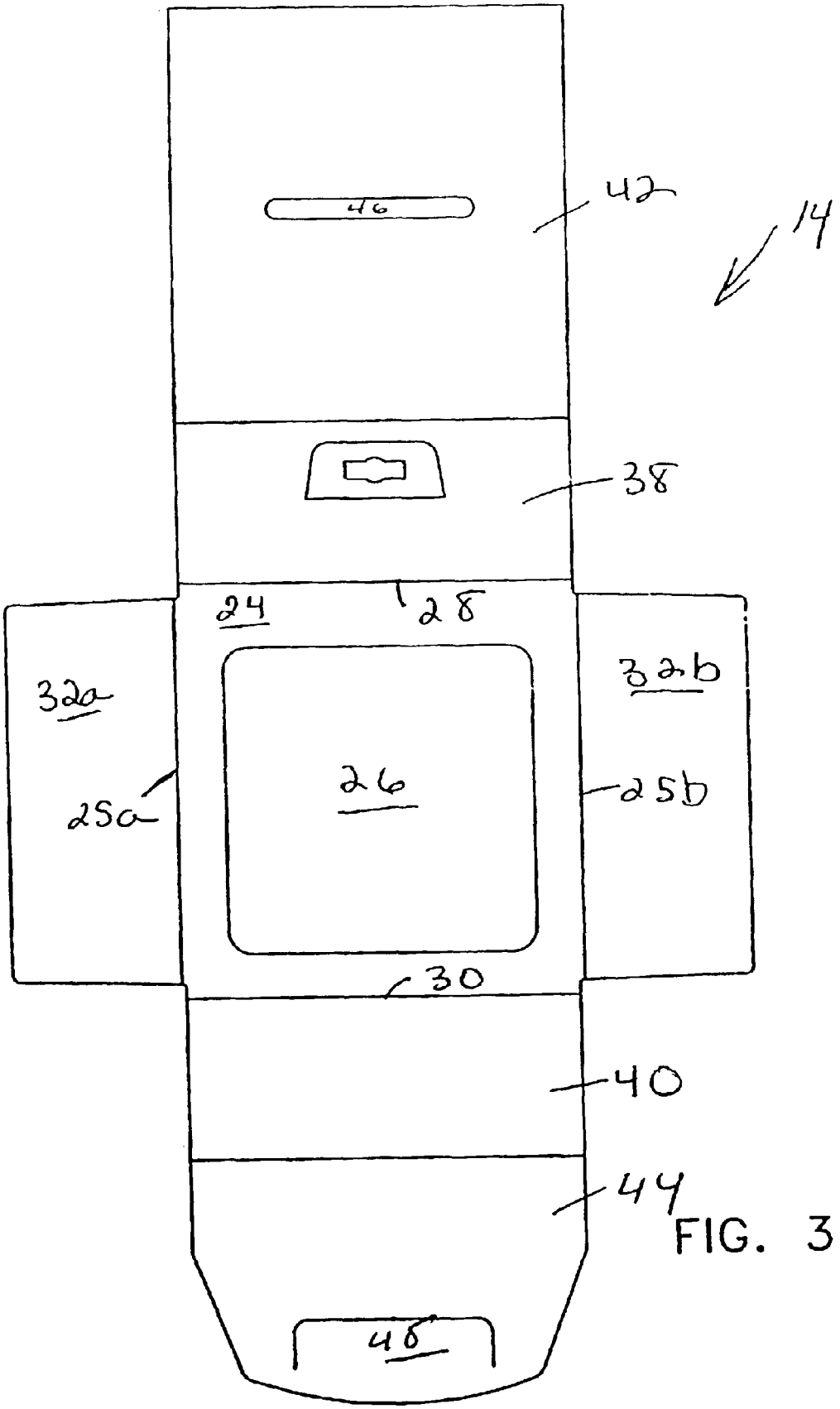
FIG. 3 is a top plan view of the sleeve of FIG. 1.
Figure 4:
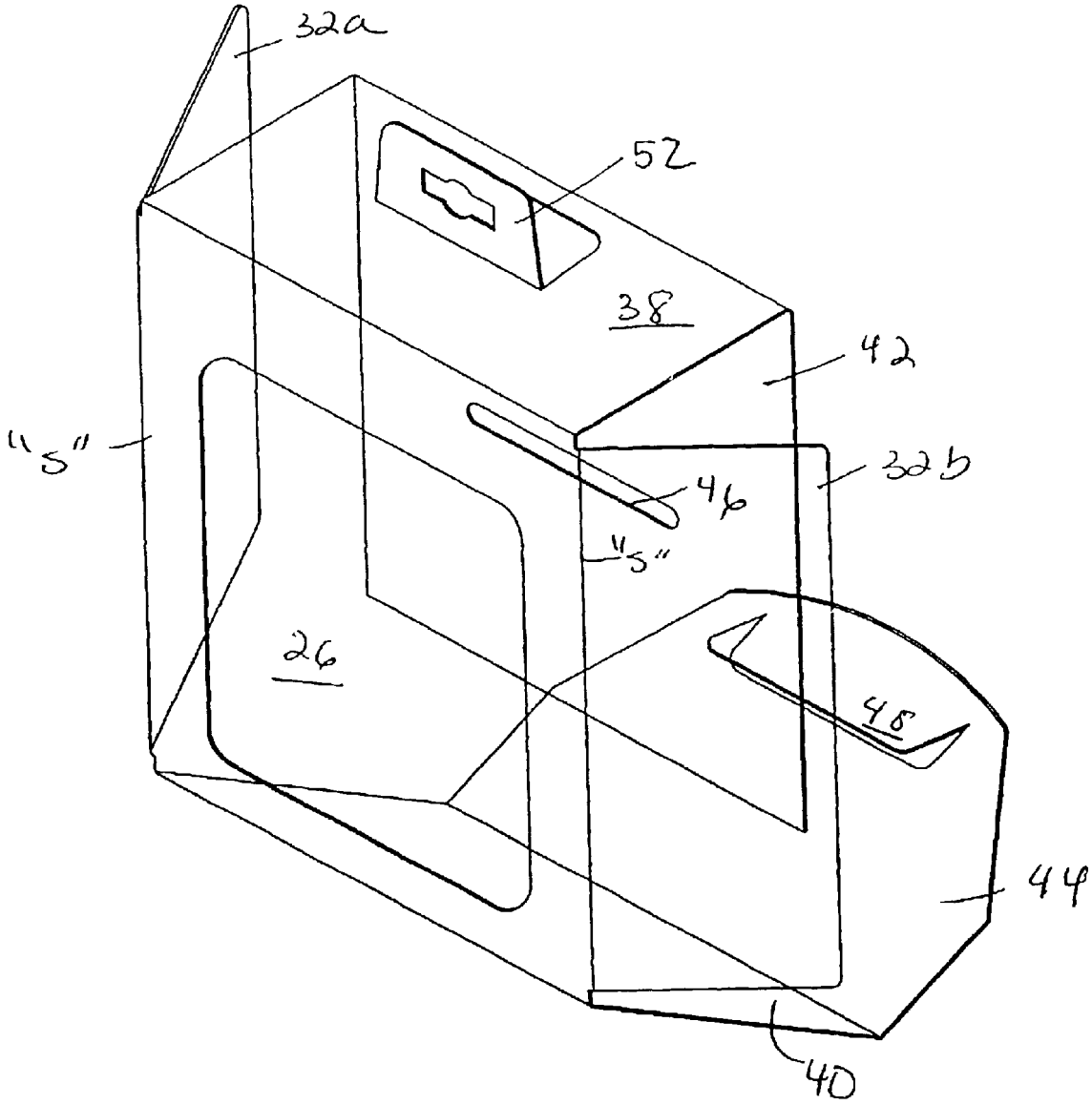
FIG. 4 is a perspective view of the sleeve of FIG. 4 during assembly.
Figure 5:
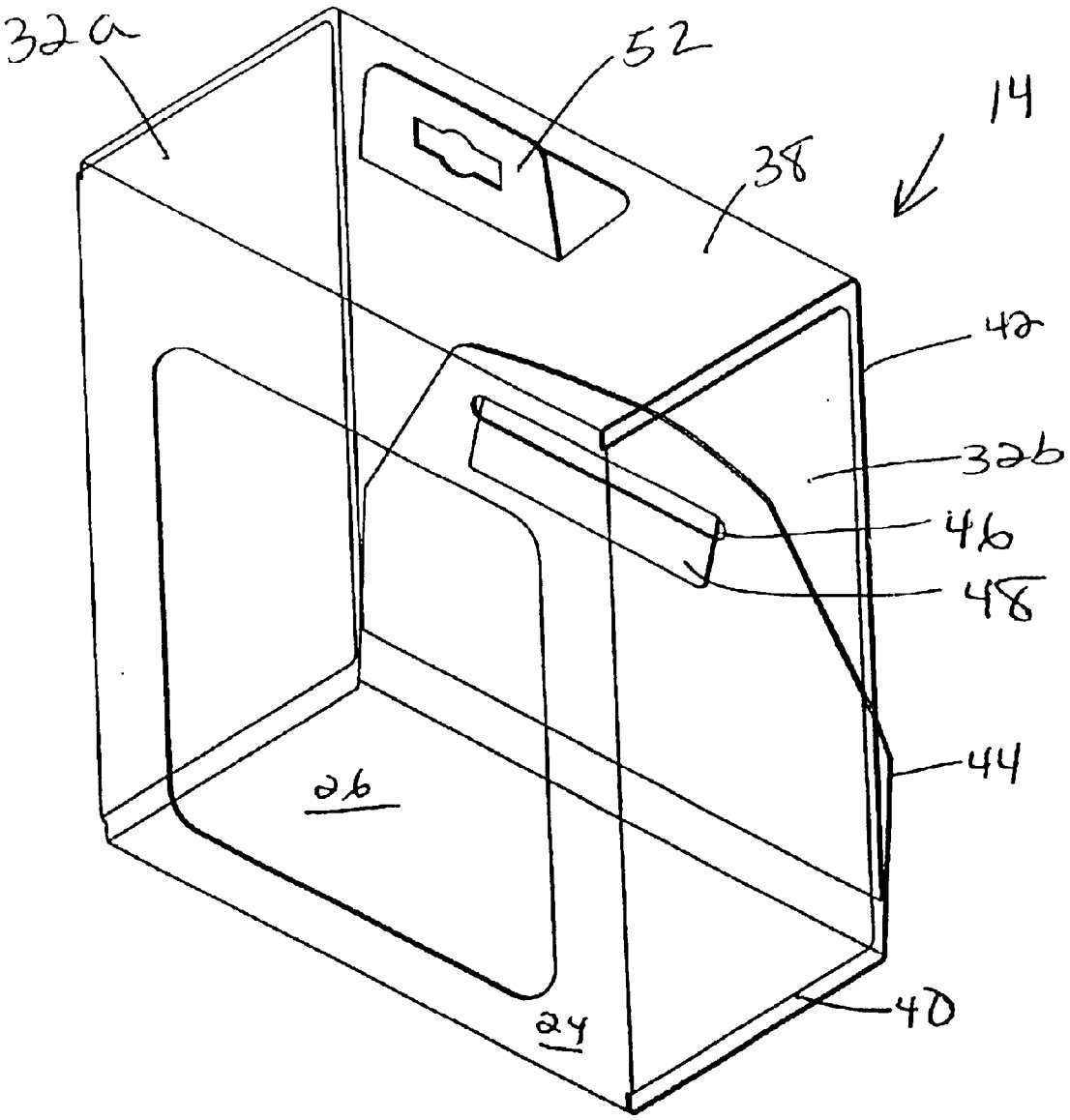
FIG. 5 is a perspective view of the sleeve of FIG. 4 assembled, without the box.

Referring now to FIG. 3, the sleeve 14 preferably includes a front member 24 having an opening or window 26 which is aligned over the open end of the box such that the ornamental object is viewable there through during use. The window may be open to the article of jewelry to allow the consumer to touch it, or may have a protective material, such as plastic, positioned over it to prevent the consumer from touching the object. The sleeve may be made of any suitable material, such as plastic, at least the window portion of the sleeve preferably being transparent. As best shown in FIG. 3, the front member 24 preferably includes a pair of side edges 25*a, b, a* top edge 28, and a bottom edge 30. A pair of foldable side tabs 32*a, b* preferably extend from either pair of the side edges 25*a, b* and are inserted adjacent an interior surface 34 of the side walls 16*a*, 16*b* of the box in order to removably secure the sleeve to the box. In the present embodiment, the side tabs 32*a, b* are inserted between the interior surface 34 of the side walls 16*a*, 16*b* and the sides 36 of the base member 22 in the assembled position. The side tabs 26 may preferably be pre-scored or otherwise have a predetermined weakened area "s" along which the side tabs are folded so as to be readily inserted within the box.

Figure 6:
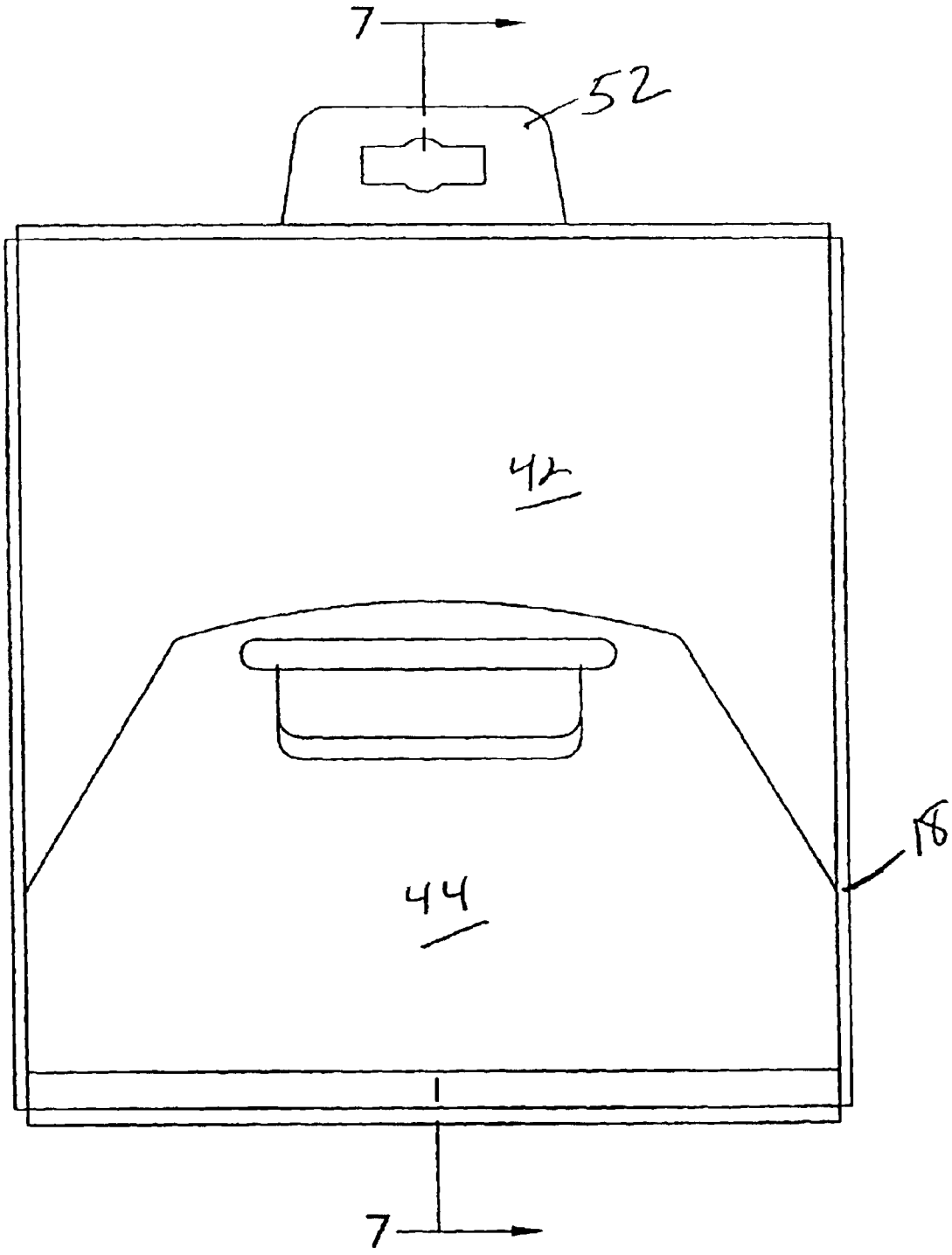
FIG. 6 is a rear plan view of the display container of FIG. 1.
Figure 7:
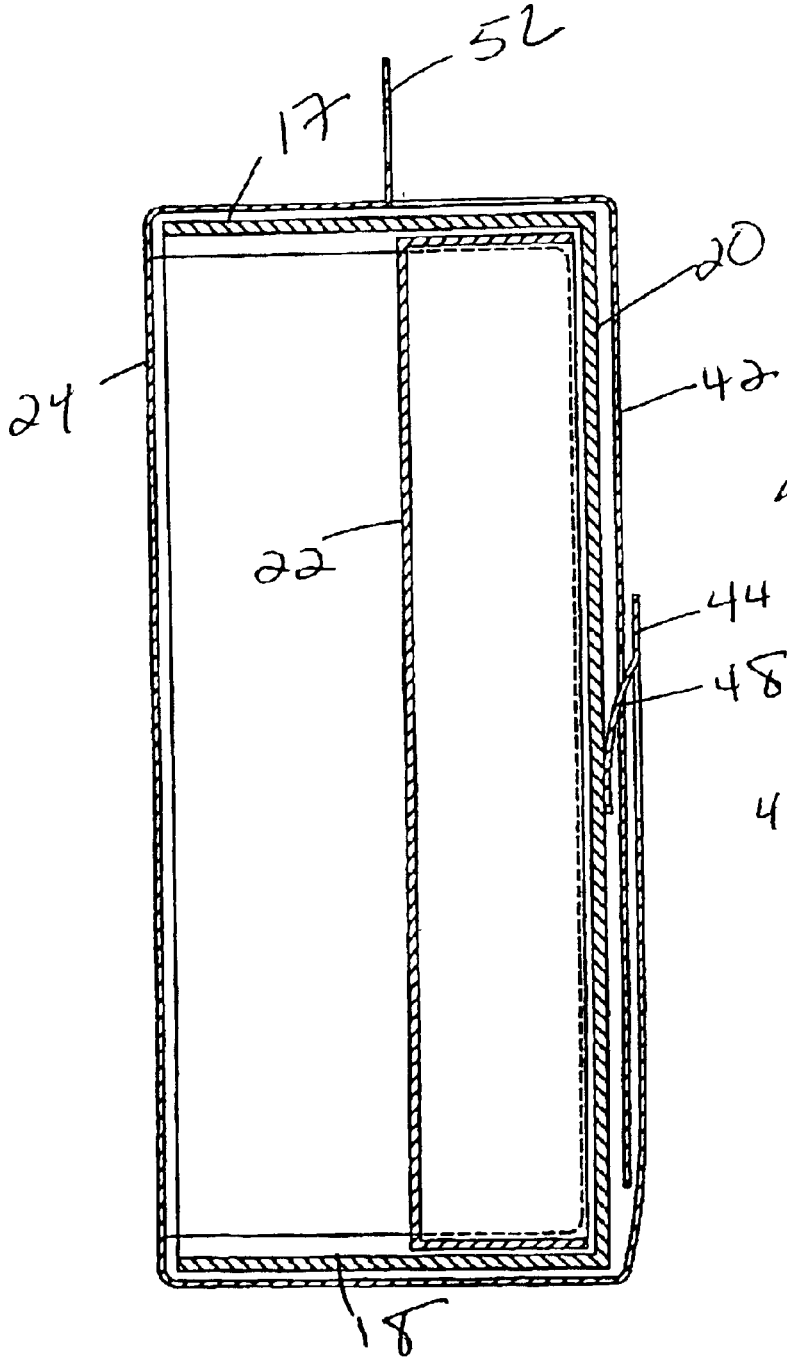
FIG. 7 is a cross-sectional view taken along lines 7—7 of FIG. 6.
Figure 8:
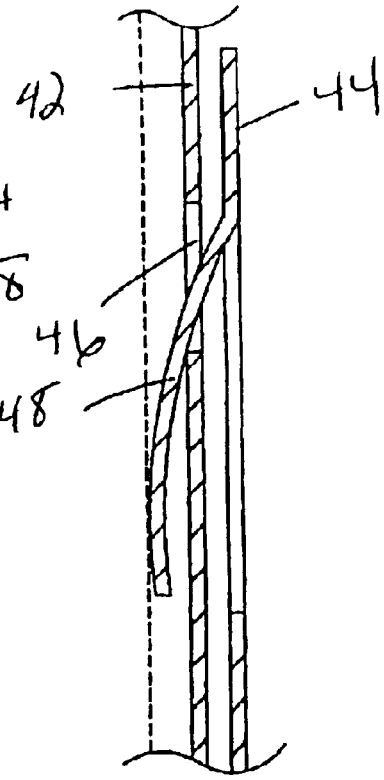
FIG. 8 is an enlarged, cross-sectional view of the rear of the sleeve member in the assembled position.
Figure 9:
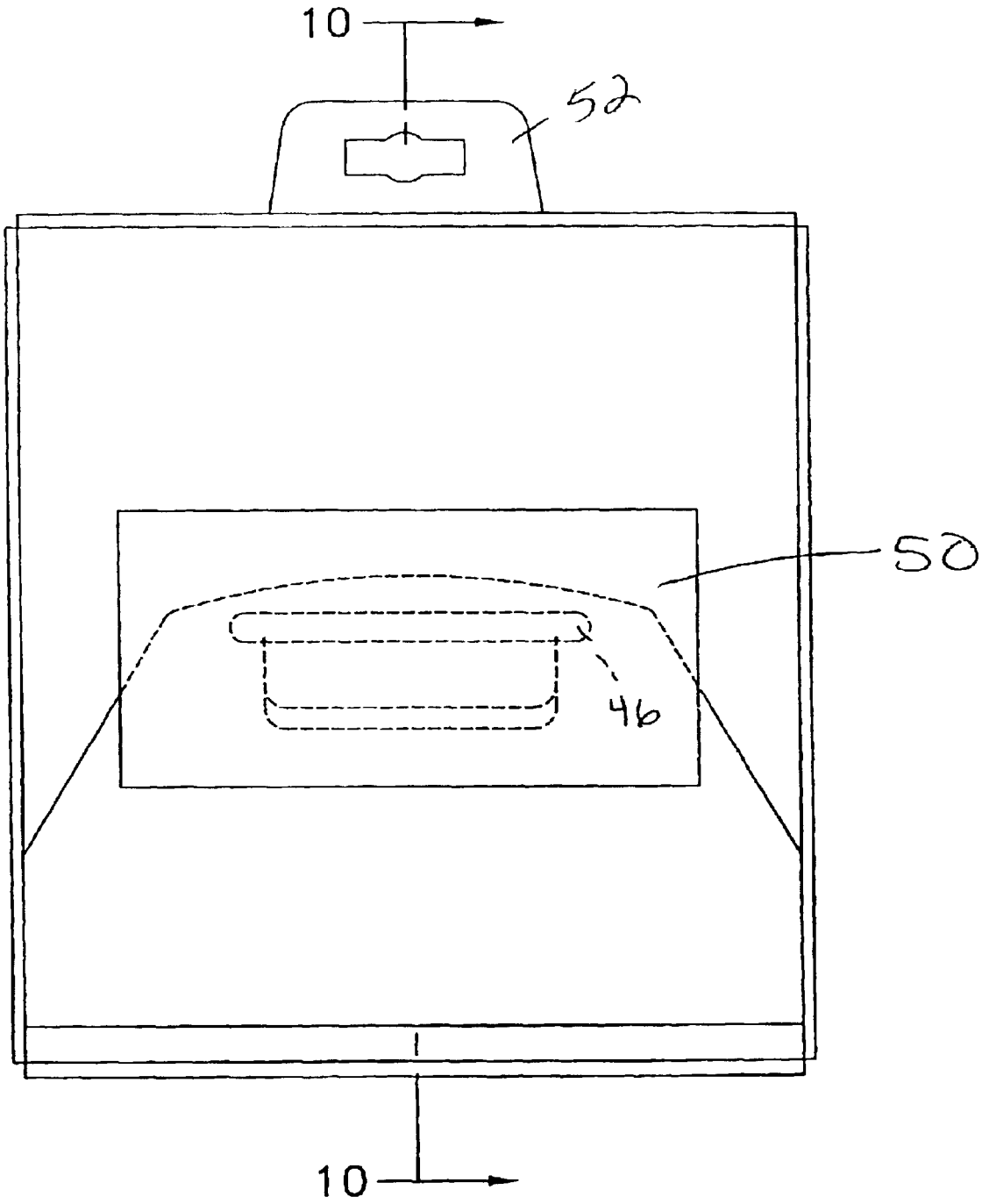
FIG. 9 is a rear plan view of the display container of FIG. 1 with a label attached.
Figure 10:
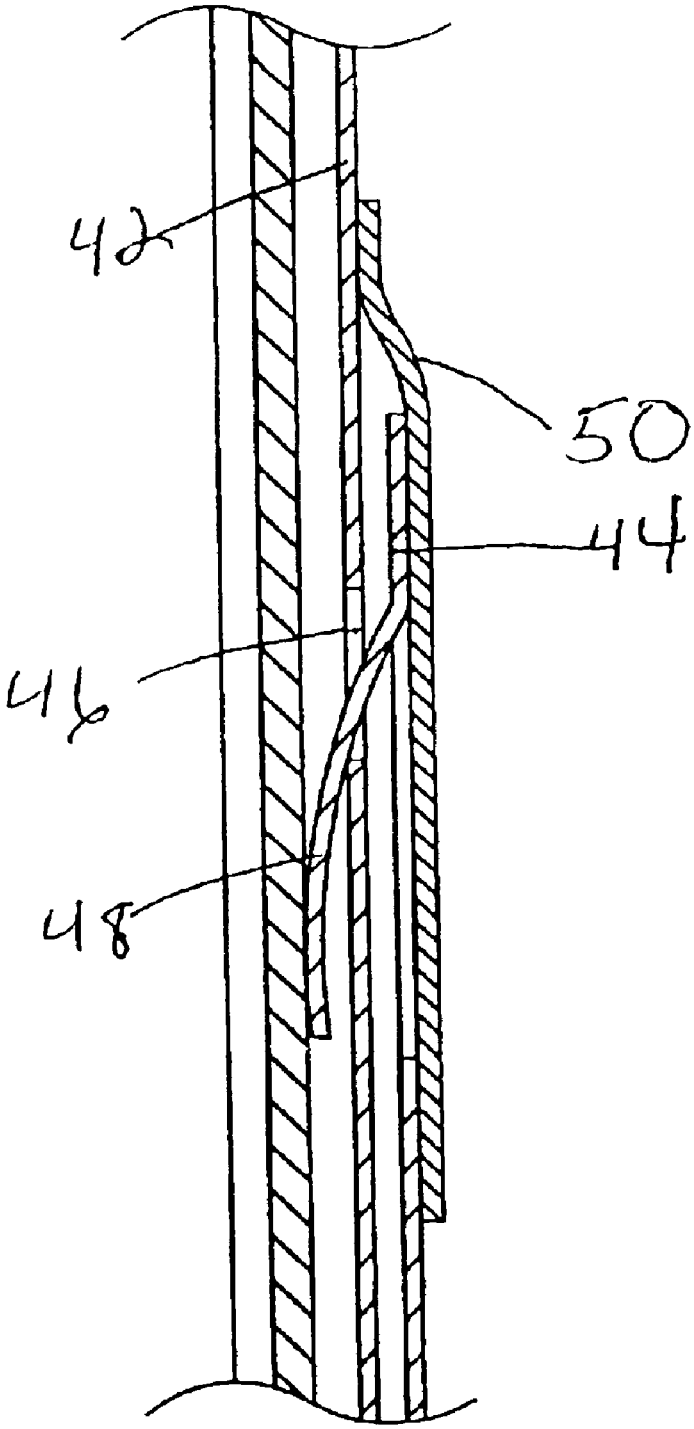
FIG. 10 is a cross-sectional view taken along lines 10—10 of FIG. 9.

In order to position the sleeve over the box once the side tabs are inserted, a foldable top tab 38 and bottom tab 40 are also provided, which extend from the top edge 28 and the bottom edge 30 of the front member 24, respectively. Again, a score line or other predetermined weakened area may be provided between the top and bottom tabs and the front member, both the top and bottom tabs being foldable along the score lines to facilitate placement of the sleeve over the top 17 and bottom 18 walls of the box. In use, the top and bottom tabs are folded so as to be positioned over and adjacent to the exterior of the top and bottom walls 17 and 18 of the box, respectively. Rear tabs 42 and 44 are also provided as part of sleeve 14, a first rear tab 42 extending from the top tab 38, and a second rear tab 44 extending from the bottom tab 40, the first and second rear tabs being inter-engaged in the assembled position. A score line may also be provided between the top and bottom tabs and the rear tabs 42, 44, the rear tabs being foldable along the score lines to facilitate placement of the sleeve over the box. The rear tabs each preferably extend over the back wall of the box and are removably interengaged by a locking member 47 when assembled. In the present embodiment, one of the rear tabs preferably includes an opening or female receptacle 46, while the other tab includes a flap 48 or male member which together form the locking member 47. The flap 48 is insertable within the opening 46 in order to secure the sleeve 14 over the box 12, as best shown in FIGS. 6–8. A label 50 may optionally be positioned over the locking member to conceal the assembly from the public. A hanger 52 may also be provided on the top tab 38 for hanging the display package.

Assembly of the display package will now be described with reference to the Figures. In use, the ornamental object 11 is supported on the base member 22. The base member 22 is inserted within the box 12, such that the sides 36 of the base member are positioned adjacent the interior surface 34 of the box. Once the ornamental object and base member are positioned within the box, the sleeve 14 is positioned around the box. The sleeve 14 is preferably positioned such that the front member 24 overlays the open end of the box 12, and so that the ornamental object 11 is viewable through the window 26. The side tabs 32*a, b* are folded and inserted between the interior surface 34 of the side walls 16*a*, 16*b* and the adjacent sides 36 of the base member 22. The top tab 38 and bottom tab 40 are then folded so as to be positioned over and adjacent to the exterior of the top wall 17 and bottom wall 18 of the box, respectively. Thereafter, the rear tabs 42, 44 are extended over the exterior of the back wall of the box and are removably interengaged by inserting the flap 48 within the opening 46 in order to secure the sleeve 14 over the box 12.

As will be appreciated, the display package disclosed herein displays an ornamental object in an attractive and reliable fashion, while also discouraging removal of the object and/or damage to the object by securing a sleeve to the box as described above.

It will be understood that various modifications may be made to the embodiment disclosed herein. For example, a display pad may be utilized with the box to support the ornamental object, and the object itself may be any type of object, other than a necklace. Also, the size and shape of the box and sleeve may be varied, as would be known to those of skill in the art. In addition, the front member itself may be transparent and may not include a window. Therefore, the above description should not be construed as limiting, but merely as exemplifications of a preferred embodiment. Those skilled in the art will envision other modifications within the scope, spirit and intent of the invention.

What is claimed is:

1. A display package for supporting an ornamental object, the package comprising:

a box including a pair of side walls, a top wall, a bottom wall, a back wall, and an open front;

a base member constructed and arranged to support the ornamental object and dimensioned to fit within the box;

a sleeve including a front member, a pair of side tabs extending from the front member and constructed and arranged to fit within the box between an interior surface of the side walls of the box and the base member, a top tab, a bottom tab, and a first and a second rear tab;

a locking member constructed and arranged to removably secure the sleeve around the box; and wherein in an assembled position the side tabs are positioned within the box between an interior surface of the side walls of the box and the base member, the top tab is positioned adjacent an exterior surface of the top wall, the bottom tab is positioned adjacent an exterior surface of the bottom wall, and the first and second rear tabs are positioned adjacent an exterior surface of the back wall.

2. The display package of claim 1, wherein the front member includes a window constructed and arranged to view the ornamental object therethrough.

3. The display package of claim 1, further comprising a label disposed over the locking member so as to substantially conceal the locking member from view.

4. The display package of claim 1, wherein the front member includes a pair of side edges, a top edge, and a bottom edge, the side tabs extending from the pair of side edges, the top tab extending from the top edge, and the bottom tab extending from the bottom edge.

5. The display package of claim 4, wherein the front member, the pair of side tabs, the top tab, the bottom tab, and the first and second rear tab are formed as a unitary member.

6. The display package of claim 5, wherein a pre-formed score line disposed between each of the side tabs and the side edges, the top tab and the top edge, the bottom tab and the bottom edge, the first rear tab and the top tab, and the second rear tab and the bottom tab, so as to facilitate folding of the side tabs, the top tab, the bottom tab and the rear tabs over the box.

7. The display package of claim 1, wherein the locking member includes an opening disposed through one of the rear tabs and a corresponding flap supported on the other of the rear tabs, the flap and opening matingly engaging each other so as to secure the sleeve around the box in the assembled position.

8. The display package of claim 1, further comprising a hanger supported on the top tab and constructed and arranged to support the package from a support member.

9. A display package for supporting an ornamental object, the package comprising:

a box including a pair of side walls, a top wall, a bottom wall, a back wall, and an open front;

a base member constructed and arranged to support the ornamental object and dimensioned to fit within the box;

a sleeve including:

a) a front member having a pair of side edges, a top edge, a bottom edge, and a window constructed and arranged to view the ornamental object therethrough;

b) a pair of side tabs, one side tab extending from each of the side edges of the front member and constructed and arranged to fit within the box between an interior surface of the side walls of the box and the base member;

c) a top tab;

d) a bottom tab; and e) a first and a second rear tab;

a pre-formed weakened line disposed between each of the side tabs and the side edges, the top tab and the top edge, the bottom tab and the bottom edge, the first rear tab and the top tab, and the second rear tab and the bottom tab, so as to facilitate folding of the side tabs, the top tab, the bottom tab and the rear tabs over the box;

a locking member constructed and arranged to removably secure the sleeve around the box; and wherein in an assembled position the side tabs are positioned within the box between an interior surface of the side walls of the box and the base member, the top tab is positioned adjacent an exterior surface of the top wall, the bottom tab is positioned adjacent an exterior surface of the bottom wall, and the first and second rear tabs are positioned adjacent an exterior surface of the back wall.

10. The display package of claim 9, further comprising a label disposed over the locking member so as to substantially conceal the locking member from view.

11. The display package of claim 9, wherein the locking member includes an opening disposed through one of the rear tabs and a corresponding flap supported on the other of the rear tabs, the flap and opening matingly engaging each other so as to secure the sleeve around the box in the assembled position.

12. The display package of claim 9, further comprising a hanger supported on the top tab and constructed and arranged to support the package from a support member.

13. A method of assembling a display package comprising the steps of:

providing a box having a pair of side walls, a top wall, a bottom wall, a back wall, and an open front;

providing a base member dimensioned to fit within the box;

providing a sleeve including a front member, a pair of side tabs, a top tab, a bottom tab, and a first and a second rear tab;

inserting the side tabs within the box between an interior surface of the side walls of the box and the base member;

folding the top tab, the bottom tab, and the first and second rear tabs over an outer surface of the box;

removably securing the sleeve to the box.

14. The method of claim 13, wherein the sleeve is secured to the box by inserting a portion of the first rear tab into an opening in the second rear tab.

15. The method of claim 14, further comprising the step of securing a label over the portion of the first rear tab which is inserted into the opening of the second rear tab.

* * * * *